US009093774B2

(12) United States Patent
Chang et al.

(10) Patent No.: US 9,093,774 B2
(45) Date of Patent: Jul. 28, 2015

(54) ELECTRICAL ADAPTER FOR IDENTIFYING THE CONNECTION STATE TO A NETWORK

(71) Applicant: INTERNATIONAL BUSINESS MACHINES CORPORATION, Armonk, NY (US)

(72) Inventors: Chun-Fei Chang, New Taipei (TW); Tzuching Kuo, Taipei (TW); Tien-Shun Wang, Taipei (TW); Lingwen Yeh, New Taipei (TW)

(73) Assignee: International Business Machines Corporation, Armonk, NY (US)

( * ) Notice: Subject to any disclaimer, the term of this patent is extended or adjusted under 35 U.S.C. 154(b) by 254 days.

(21) Appl. No.: 13/860,831

(22) Filed: Apr. 11, 2013

(65) Prior Publication Data

US 2013/0288516 A1 Oct. 31, 2013

(30) Foreign Application Priority Data

Apr. 30, 2012 (TW) ..... 101115432 A

(51) Int. Cl.

| | |
|---|---|
| ***H01R 3/00*** | (2006.01) |
| ***H01R 13/46*** | (2006.01) |
| ***H01R 13/635*** | (2006.01) |
| ***H01R 13/641*** | (2006.01) |
| ***H01R 31/06*** | (2006.01) |
| *H01R 24/64* | (2011.01) |

(52) U.S. Cl.

CPC ..... *H01R 13/465* (2013.01); *H01R 13/635* (2013.01); *H01R 13/641* (2013.01); *H01R 31/06* (2013.01); *H01R 24/64* (2013.01); *H01R 2201/04* (2013.01)

(58) Field of Classification Search

CPC ..... H01R 13/641
USPC ..... 439/489, 490, 52, 640; 200/51.09
See application file for complete search history.

(56) References Cited

U.S. PATENT DOCUMENTS

| | | | | |
|---|---|---|---|---|
| 2,735,906 | A * | 2/1956 | Avrunin | 200/51.09 |
| 4,319,106 | A | 3/1982 | Armitage | |
| 4,902,244 | A * | 2/1990 | Endo et al. | 439/489 |
| 5,043,546 | A | 8/1991 | Krause | |
| 6,095,850 | A * | 8/2000 | Liu | 439/488 |
| 6,350,148 | B1 * | 2/2002 | Bartolutti et al. | 439/489 |
| 6,585,388 | B2 | 7/2003 | Kim | |
| 6,589,076 | B1 | 7/2003 | Davis et al. | |

(Continued)

FOREIGN PATENT DOCUMENTS

| | | |
|---|---|---|
| CN | 2465344 | 12/2001 |
| CN | 201156614 | 11/2008 |

*Primary Examiner* — Neil Abrams
(74) *Attorney, Agent, or Firm* — Law Office of Jim Boice

(57) ABSTRACT

An electrical adapter for identifying the connection state to a network is presented. The adapter comprises a first member and a second member. The first member comprises a male end that is substantially similar in shape to a connector plug, and which electrically connects to a wall outlet or a female receptacle. A first female end is disposed at another end of the first member, which includes a hollow cylinder member and a display window. The second member comprises a second female end which comprises a push latch and a mark for identifying a connection state to a network. When the second member is pushed forward, the second female end is engaged with the first female end via the push latch, and a display window displays the mark that identifies the electrical adapter's connection state to the network.

8 Claims, 11 Drawing Sheets

(56) References Cited

U.S. PATENT DOCUMENTS

| | | | | |
|---|---|---|---|---|
| 6,595,791 | B2 | 7/2003 | Below et al. | |
| 6,660,950 | B2 * | 12/2003 | Fonseca | 200/51 R |
| 6,796,844 | B1 | 9/2004 | Edwards, III | |
| 6,853,316 | B2 | 2/2005 | Payson et al. | |
| 6,979,787 | B2 * | 12/2005 | Davies | 200/51 R |
| 7,025,636 | B2 | 4/2006 | Allen | |
| 7,156,683 | B2 | 1/2007 | Gupta et al. | |
| 7,160,143 | B2 * | 1/2007 | David et al. | 439/489 |
| 7,361,047 | B2 | 4/2008 | Strahl | |
| 7,384,300 | B1 * | 6/2008 | Salgado et al. | 439/489 |
| 7,484,993 | B2 | 2/2009 | Amidon et al. | |
| 7,605,707 | B2 * | 10/2009 | German et al. | 340/572.8 |
| 7,901,250 | B2 | 3/2011 | Lam et al. | |
| 7,985,100 | B2 | 7/2011 | Jaouen et al. | |
| 7,985,102 | B2 | 7/2011 | Bergner et al. | |
| 8,092,249 | B2 * | 1/2012 | German et al. | 439/489 |
| 8,177,565 | B2 * | 5/2012 | Bowen | 439/134 |
| 8,419,464 | B2 * | 4/2013 | Montena et al. | 439/489 |
| 8,556,651 | B1 * | 10/2013 | Heitmann et al. | 439/489 |
| 8,588,050 | B2 * | 11/2013 | Caveney et al. | 370/200 |
| 8,643,476 | B2 * | 2/2014 | Pinn et al. | 340/10.6 |
| 8,651,892 | B2 * | 2/2014 | Arant | 439/489 |
| 8,704,673 | B2 * | 4/2014 | Chang | 340/654 |
| 2001/0034156 | A1 * | 10/2001 | Yamane | 439/492 |
| 2005/0064752 | A1 | 3/2005 | Serino | |
| 2010/0068912 | A1 | 3/2010 | Cole et al. | |
| 2013/0288516 | A1 * | 10/2013 | Chang et al. | 439/488 |

* cited by examiner

ELECTRICAL ADAPTER FOR IDENTIFYING THE CONNECTION STATE TO A NETWORK

This application is based on and claims the benefit of priority from Taiwan Patent Application 101115432, filed on Apr. 30, 2012, which is herein incorporated by reference in its entirety.

BACKGROUND

The present invention relates to an electrical adapter for identifying a connection state to a network, and particularly to a novel electrical adapter, such that while a network connector is still inserted into a network port of a device, there is no need to unplug the cord to disable the network for the device.

A signal transmission cable, such as a telephone line, an optical fiber wire, an Ethernet cord and the like, is usually connected to a wall outlet or a corresponding female receptacle on another device through a flexible conductor or conductive wire with a plug-in connector at its end. The conventional RJ11, 8P8C (also called RJ45), MT-RJ and LC optical fiber connectors are all examples of the plug-in connector.

A computer system is normally connected to a certain type of network for resource sharing. Examples of these types of networks include Internet, Wide Area Networks (WAN) and Local Area Networks (LAN). In order to tap onto a network, such as a LAN, a client computer must employ a wireless or hard-wired method to be coupled to the LAN. The common hard-wired method employs the conventional RJ45 connector.

FIG. 1 illustrates a cross-sectional side view of the plug of the conventional RJ45 connector. As shown, the conventional RJ45 plug 100 is basically made of plastic, and comprises a flexible retention latch 130 and a latch base 120. The retention latch 130 is also known as a connector tab or a latching tab, and is integrally formed as a part of RJ45 plug 100 by die casting. The retention latch 130 is composed of a thinner flexible section 132 coupled to the latch base 120 and a stem 134. The connection between the flexible section 132 and the stem 134 is provided with a pair of shoulders 136 as lock points. There is a vacant space 138 between the retention latch 130 and a body of the RJ45 plug 100 such that the retention latch 130 can be flexed in the vacant space 138. The rear end of the RJ45 plug 100 is attached to a network cable 110. Furthermore, the conventional RJ11, Mechanical Transfer Registered Jack (MT-RJ), and LC optical fiber plugs all have the flexible retention latch.

When the RJ45 plug 100 is inserted into a wall outlet or a network port on a computer system, the retention latch 130 on the plug 100 is flexed when crossing a pair of separated retention lips 139 inside a female receptacle 200, as shown in FIG. 2, and is snapped in to engage a pair of shoulders 136 of the retention latch 130 with a pair of separated retention lips 139 inside the female receptacle 200, and then form the locked attachment with the female receptacle 200. While disconnecting the RJ 45 plug 100, the stem 134 of the retention latch 130 extending outside the female receptacle 200 is pressed to disengage the shoulders 136 from the retention lips 139, so that the RJ45 plug 100 can be removed.

SUMMARY

One embodiment of the present invention provides a novel electrical adapter, such that there is no need to unplug the cord for disabling the Internet for a device while a network connector is still inserted into the network port of the device.

One embodiment of the present invention discloses an electrical adapter for identifying the connection state of network, comprising: a first member, comprising: a male end, disposed at one end of the first member and substantially similar to a connector plug and electrically connected to a wall outlet or a corresponding female receptacle on another device when engaged therewith; a first female end, disposed at another end of the first member and including a hollow cylinder member and a display window; and a second member, comprising a second female end comprising a push latch and a mark for identifying the connection state of network on a surface of the second female end; wherein the push latch is contained in the hollow cylinder member; and wherein when the second member is pushed forward, the second female end is engaged with the first female end via the push latch, and the display window displays the mark of the connection state of network for identification.

BRIEF DESCRIPTION OF THE SEVERAL VIEWS OF THE DRAWINGS

In order that the advantages of the invention will be readily understood, a more particular description of the invention briefly described above will be rendered by reference to specific embodiments that are illustrated in the appended drawings. Understanding that these drawings depict only exemplary embodiments of the invention and are not therefore to be considered to be limiting of its scope, the invention will be described and explained with additional specificity and detail through the use of the accompanying drawings.

FIG. 6-1*c* depicts a perspective view of a rotor member according to an embodiment of the present invention;

FIG. 6-2*a* depicts a cross-sectional view of an actuator member in accordance with an embodiment of the present invention;

FIG. 6-2*b* depicts a cross-sectional view of a rotor member in accordance with an embodiment of the present invention;

FIG. 6-2*c* illustrates a side view showing the rotor member and the actuator member being completely engaged in accordance with an embodiment of the present invention;

FIGS. 6-3*a* and 6-3*b* depict other side views of the second portion of an adapter connected with a spring in accordance with an embodiment of the present invention;

FIG. 6-4 depicts another side view showing the second portion of an adapter inserted into a hollow cylinder member inside the first female end of the first portion in accordance with an embodiment if the present invention;

FIG. 6-5*a* illustrates a cross-sectional view of the hollow cylinder member depicted in FIG. 6-4; and FIG. 6-5*b* is a plan view of a surface covering 120 degrees of an inner wall of the hollow cylinder member.

DETAILED DESCRIPTION

In a network environment under normal operation, the network administrator sometimes wants to disable the network while the network connector is still inserted into the network port of a device (computer system). For example, while administrating a server room, there are many Ethernet cords and/or network ports. The network administrator sometimes wants to unplug an Ethernet cord to disable the Internet for some devices, but possibly forgets at a later time the correct network port that originally corresponding to the cord. Moreover, while configuring a network room, the network administrator sometimes want to plug the Ethernet cord into a network port of a device, but does not want to actually enable the Internet (i.e., a connection to a network, such as the Internet, a LAN, etc.). Therefore, there is a need for a practical and reliable solution for meeting the requirement of actually disabling the network while the network connector is still inserted into the network port of a device.

One or more embodiments of the present invention are described in detail below. The disclosed embodiment(s) are only used for illustration, while the person skilled in the art should understand there can be a lot of modifications and variations. While referring to the figures, the same reference numbers represent the same parts in all figures.

The present invention is designed to be able to disable the Internet for a device with no need to unplug the network connector from a network port of the device. For convenience of description, the embodiment disclosed by the present invention employs RJ45 as the example. The person skilled in the art should understand the present invention should be similarly suitable for an RJ11 plug, an MT-RJ plug or an LC optical fiber plug.

Figure 3A:
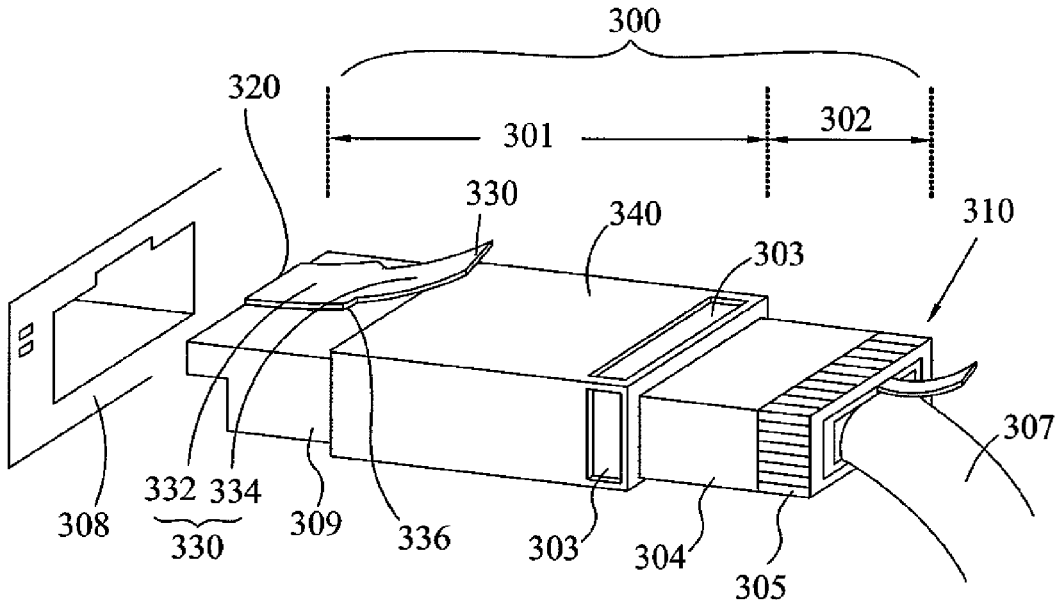
FIGS. 3*a* to 3*b* respectively illustrate perspective assembly views of an adapter in accordance with an embodiment of the present invention.
Figure 3B:
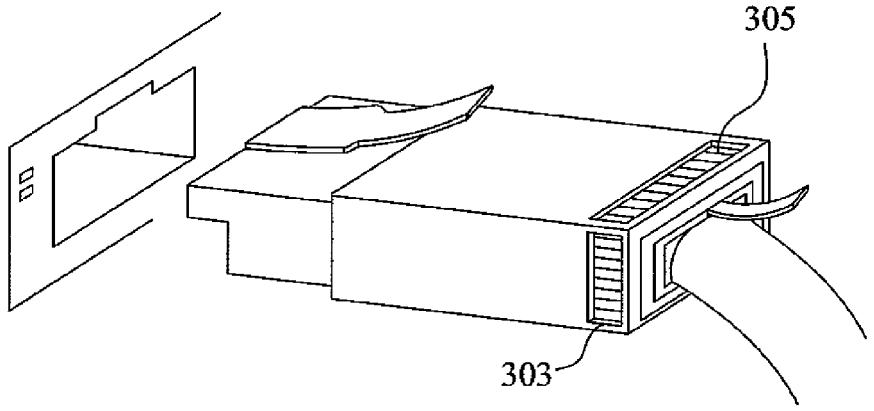

With reference now to FIGS. 3*a*-3*b*, an illustration of perspective assembly views of an adapter according to an embodiment of the present invention is presented. As shown in FIG. 3*a*, the adapter 300 in one embodiment is constructed of plastic, and comprises a first portion 301 (i.e., a "first member") and a second portion 302 (i.e., a "second member"). One end of the first portion 301 is a male end 309 similar to an RJ45 plug 100, and the other end is a first female end 340 with a display window 303. A user easily determines if the network is disabled through the display window 303 with no need to unplug the network connector for disabling the network. According an embodiment of the present invention, a color appears in the display window 303 to identify whether the connection to the network is enabled/disabled (connected/disconnected). For example, a green color indicates the network is still connected, and a red color indicates the network is disabled. The determination/configuration of the display window 303 may be assigned by the actual situation, which is not limited by the present invention.

The first female end 340 further comprises electrical contacts (not shown) for electrically connecting with the electrical contacts (not shown) of the RJ45 plug inserted into a second portion 302. The male end 309 is substantially similar to a RJ45 connector 100 in shape, and comprises a flexible retention latch 330 and a latch base 320. The retention latch 330 is composed of a flexible section 332 coupled to the latch base 320 and a stem 334. The connection between the flexible section 332 and the stem 334 is provided with a pair of shoulders 336 as lock points. When the adapter 300 is inserted into a wall outlet or a corresponding female receptacle 308 on another device, such as a computer system, Asymmetric Digital Subscriber Line (ADSL) modem and the like, the pair of shoulders 336 are engaged with a pair of separated retention lips inside the female receptacle 308, and form the locked attachment (not shown) with the female receptacle 308. The male end 309 further comprises electrical contacts (not shown) for electrically connecting the adapter 300 with a wall outlet or a corresponding female receptacle 308 on another device.

The second portion 302 comprises a second female end 310 which may accommodate an RJ45 plug 307. The surface of the second female end has two colors, i.e., a green zone 305 and a red zone 304. As shown in FIG. 3*b*, when the RJ45 plug 307 is inserted into the second portion 302 and pushed forward such that the display window 303 of the first portion 301 shows the green color, the electrical contacts included in the RJ45 plug 307 are electrically connected with the electrical contacts (not shown) of the first female end 340.

Figure 1:
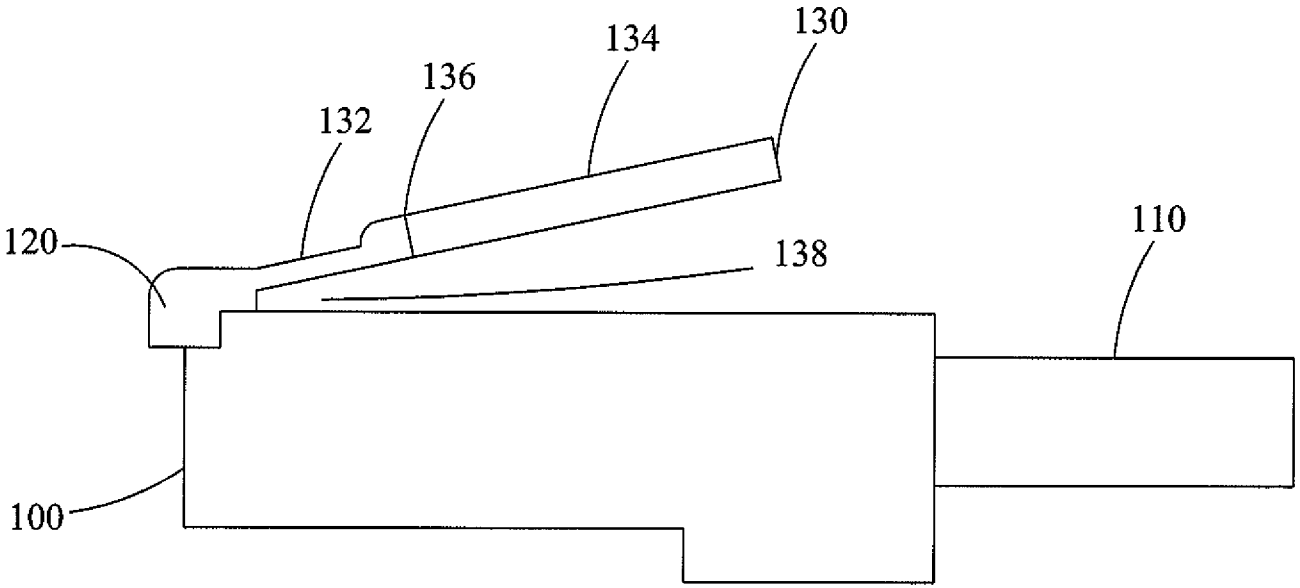
FIG. 1 (Prior Art)
FIG. 1 is a cross-sectional side view of a prior art conventional RJ45 plug.
Figure 2:
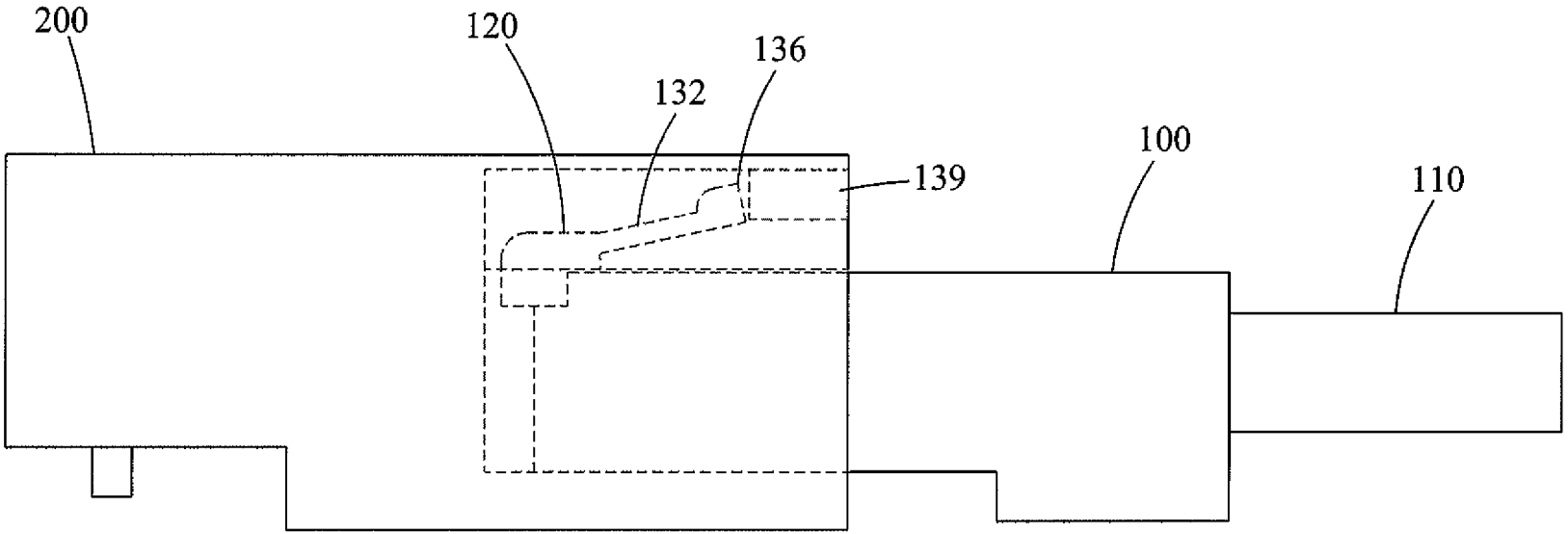
FIG. 2 (Prior Art)
FIG. 2 is a cross-sectional side view of a prior art conventional RJ45 plug with damaged retention latch engaged with a RJ45 receptacle.
Figure 4A:
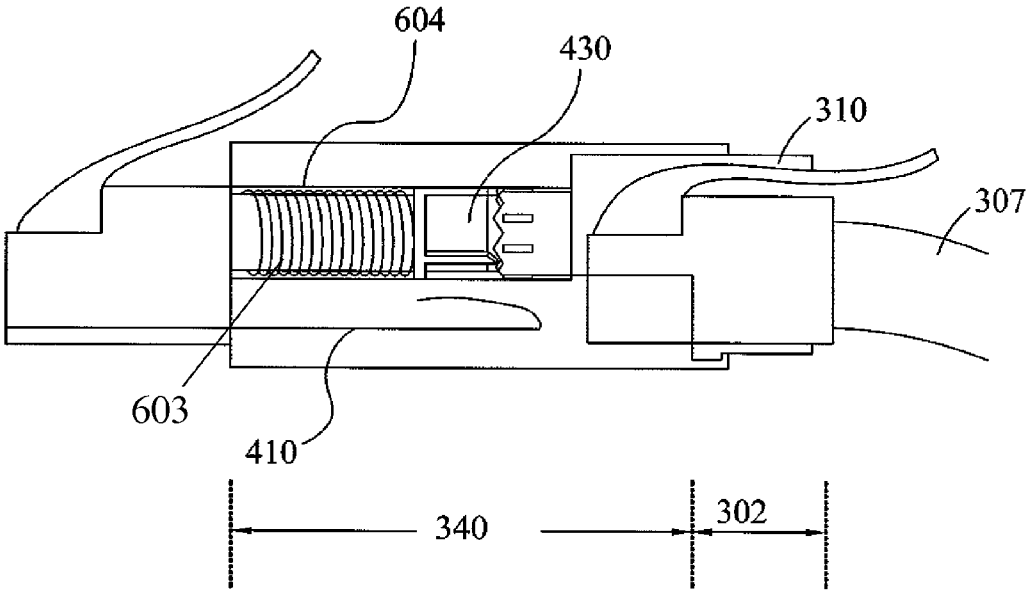
FIGS. 4*a* and 4*b* respectively depict side views of a disconnection state and a connection state for an adapter in accordance with an embodiment of the present invention.
Figure 4B:
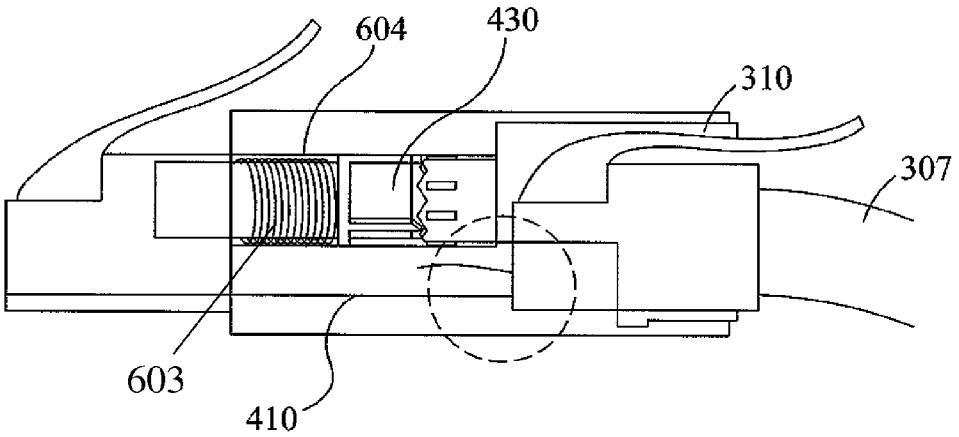

FIGS. 4*a* and 4*b* respectively depict the side views of a disconnection state and a connection state for the adapter 300 according to an embodiment of the present invention. The first female end 340 of the first portion 301 comprises a network cable 410, which is electrically connected with the electrical contacts of the inserted RJ45 plug 307. The first female end 340 further comprises a hollow cylinder member 604 for accommodating a push latch 430. The push latch 430 comprises a rotor member 601, an actuator member 610 and a spring 603. The detailed content will be further described by referring to FIGS. 6-1 to 6-5. When the spring 603 is loosened, the inserted RJ45 plug 307 is not electrically connected with the adapter 300. However, when the spring 603 is not loosened (i.e., is compressed) and the push latch 430 is locked, the inserted RJ45 plug 307 is electrically connected with the adapter 300 according to the present invention. The RJ45 plug 307 comprises electrical contacts to be electrically connected with the network cable 410 of the first portion 301.

Figure 5:
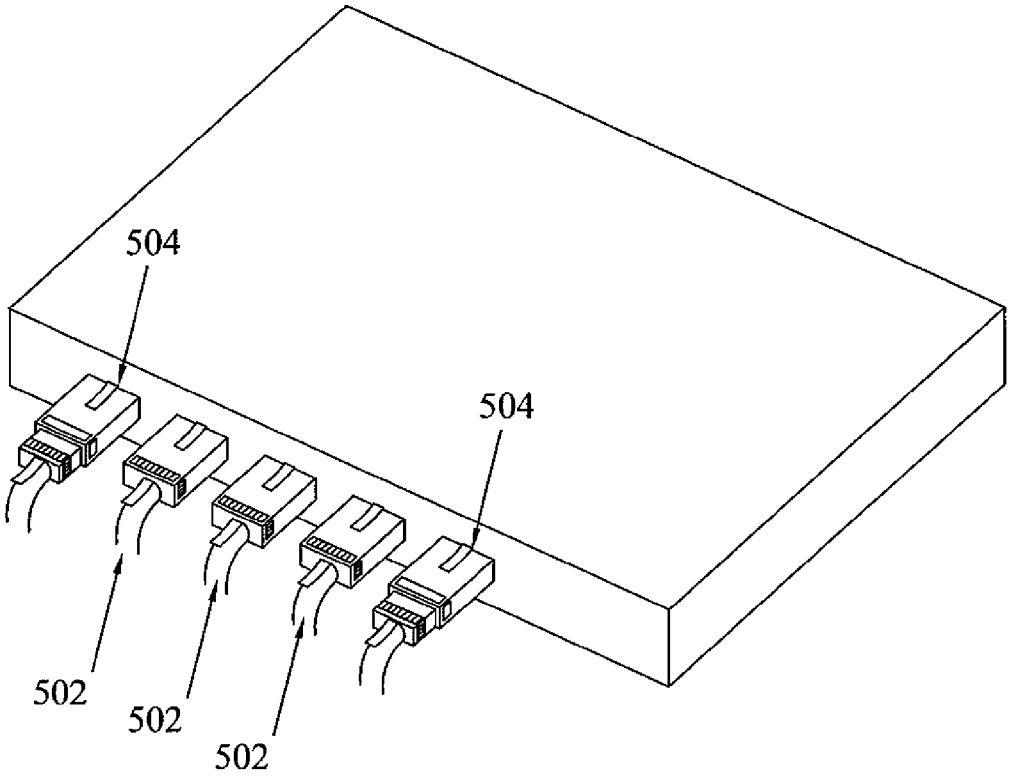
FIG. 5 depicts a perspective view of an embodiment of the present invention that includes a plurality of adapters and the actual usage state thereof.

FIG. 5 depicts a perspective view of an embodiment of the present invention that includes a plurality of adapters 300 and the actual usage state thereof. It should be recognized that the first and the fifth adapters 504 are under a state of electrical disconnection, and the second to fourth adapters 502 are under a state of electrical connection.

Figures 1A, 6:
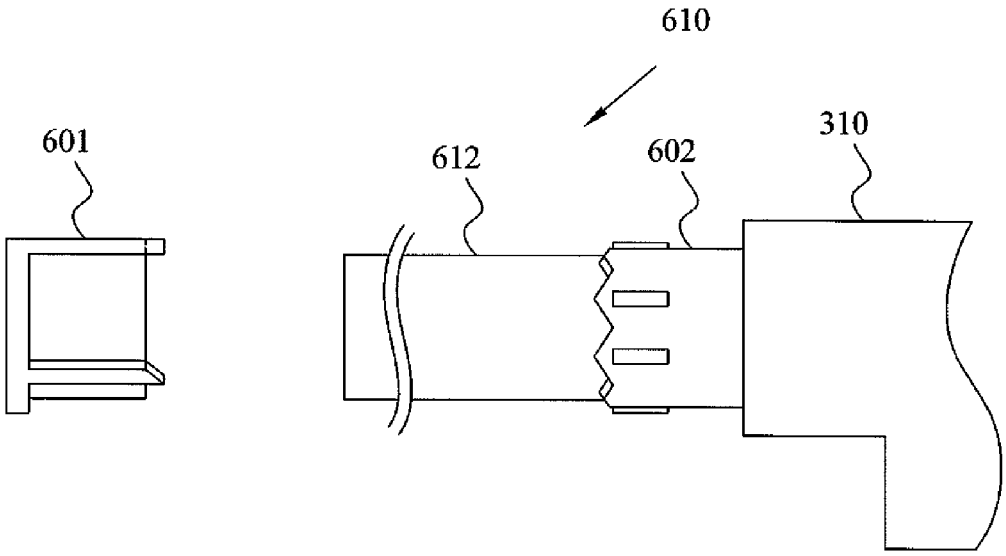
FIGS. 6-1*a* and 6-1*b* depict the side views of the second portion of the adapter according to an embodiment of the present invention.
Figures 1B, 6:
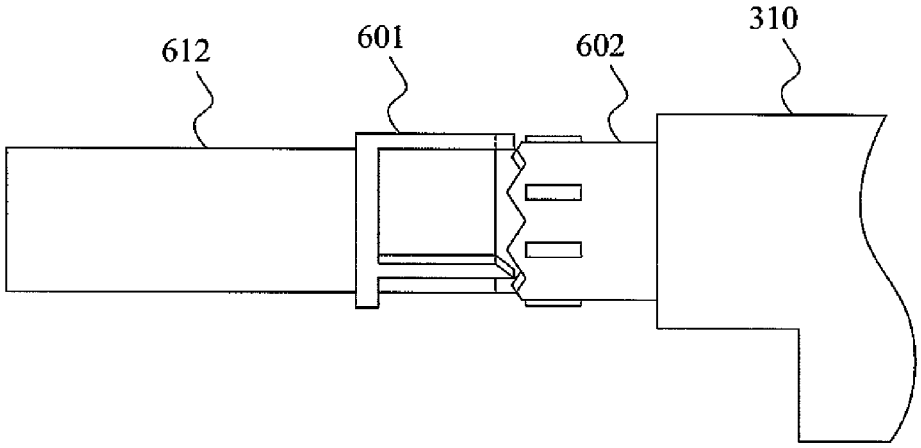

FIGS. 6-1*a* and 6-1*b* depict the side views of the second portion 302 of the adapter 300 depicted in FIGS. 3*a*-3*b*. As shown in FIGS. 6-1*a* and 6-1*b*, the second portion 302 comprises a second female end 310 which can accommodate a RJ45 plug 307, as well as an actuator member 610 (as depicted in FIG. 6-1*a*). The actuator member 610 comprises an actuator 602 and a rod 612.

Figures 1C, 6:
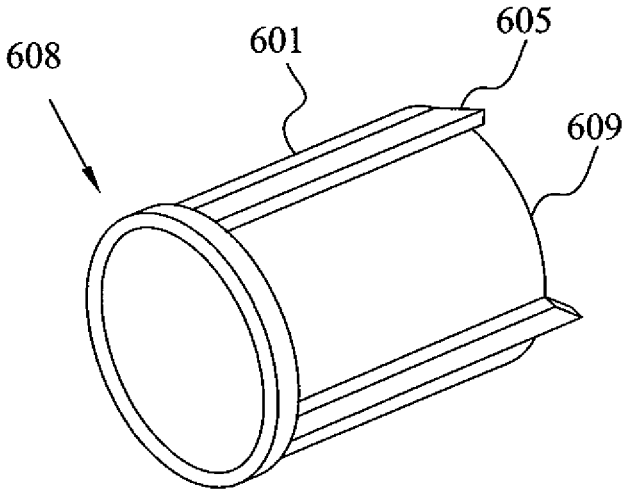
Figures 2A, 6:
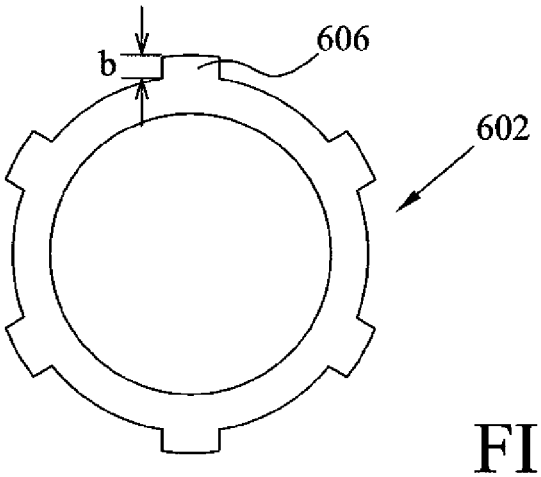
Figures 2B, 6:
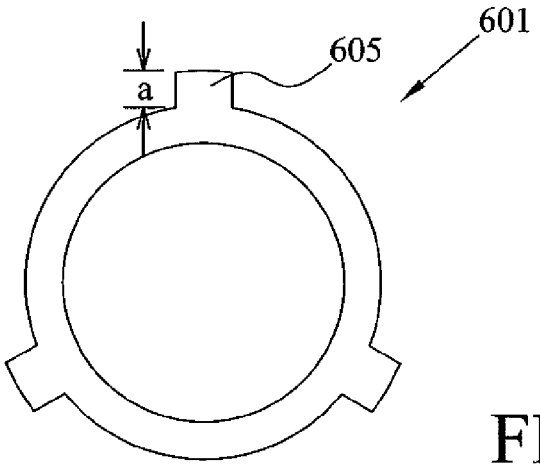
Figures 2C, 6:
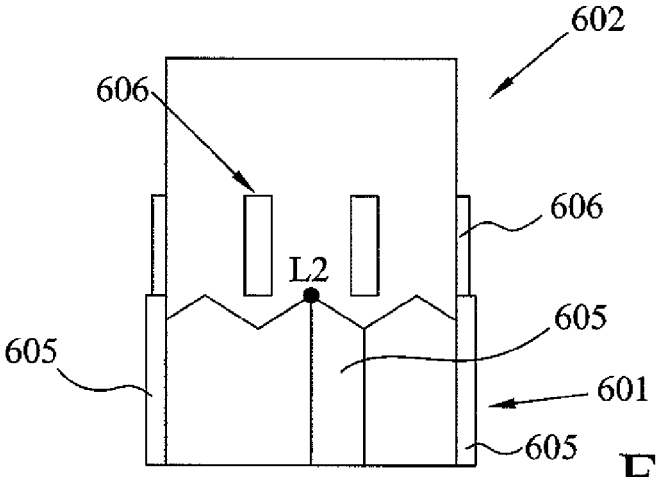
Figures 3A, 6:
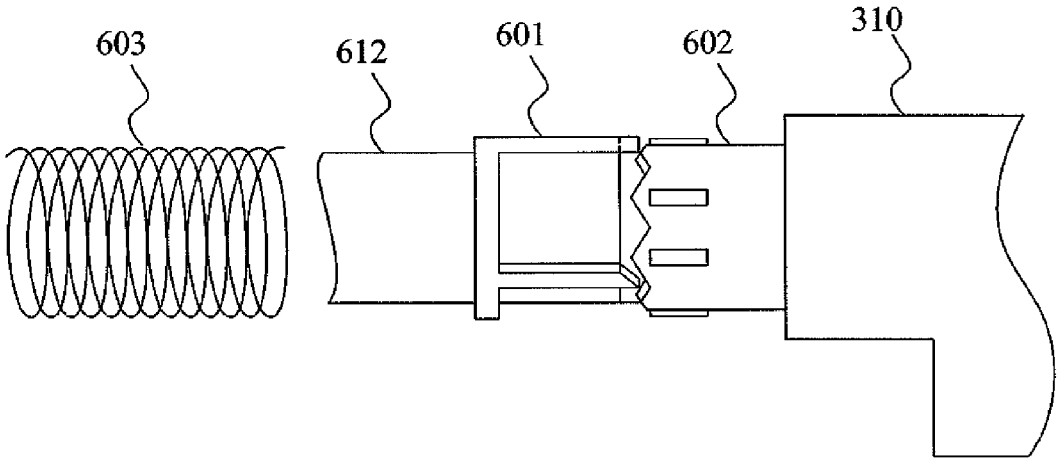
Figures 3B, 6:
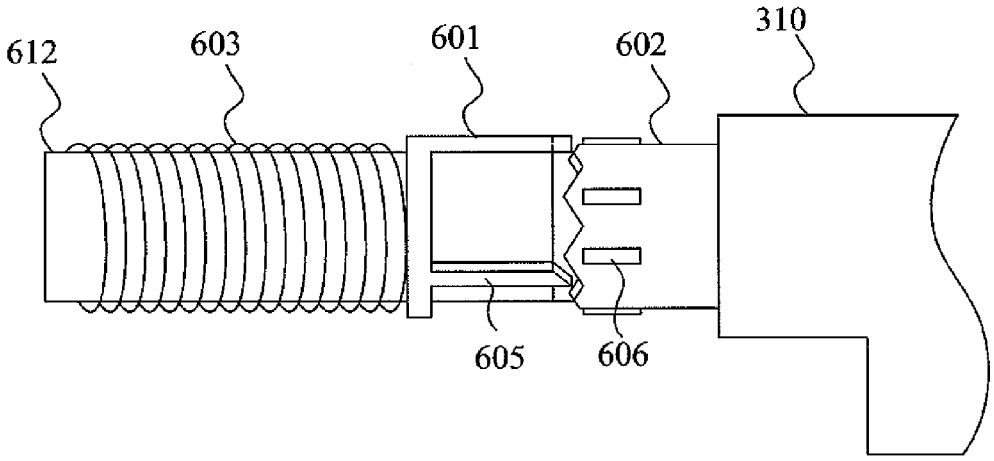

As shown in FIG. 6-2*a*, in one embodiment the actuator 602 has a toothed edge comprising six peaks, and comprises six equidistant protruding ears 606 which respectively have a radial thickness of b and extend outward from the exterior of the peaks. As shown in FIG. 6-3*a*, a rod 612 may be inserted into a rotor member 601 (as shown in the perspective view of FIG. 6-1*c*), and the rotor member 601 may be engaged with the actuator 602. As shown in FIG. 6-2*b*, the rotor member 601 has a toothed edge comprising three peaks, and comprises three equidistant protruding ears 605 which respectively have a radial thickness a and extend outwardly from the exterior of the peaks. The radial thickness a is larger than the radial thickness b. As shown in FIG. 6-1*c*, atop each of the protruding ears 605 is a sloped surface. Another end of the rotor member 601 comprises a chassis 608 extending to the protruding ears 605. The chassis may be a hollow annular disk only covering the protruding ears 605 and a body 609 of the rotor member 601. FIG. 6-2*c* illustrates a side view showing the actuator 602 and the rotor member 601 when completely engaged.

Figures 4, 6:
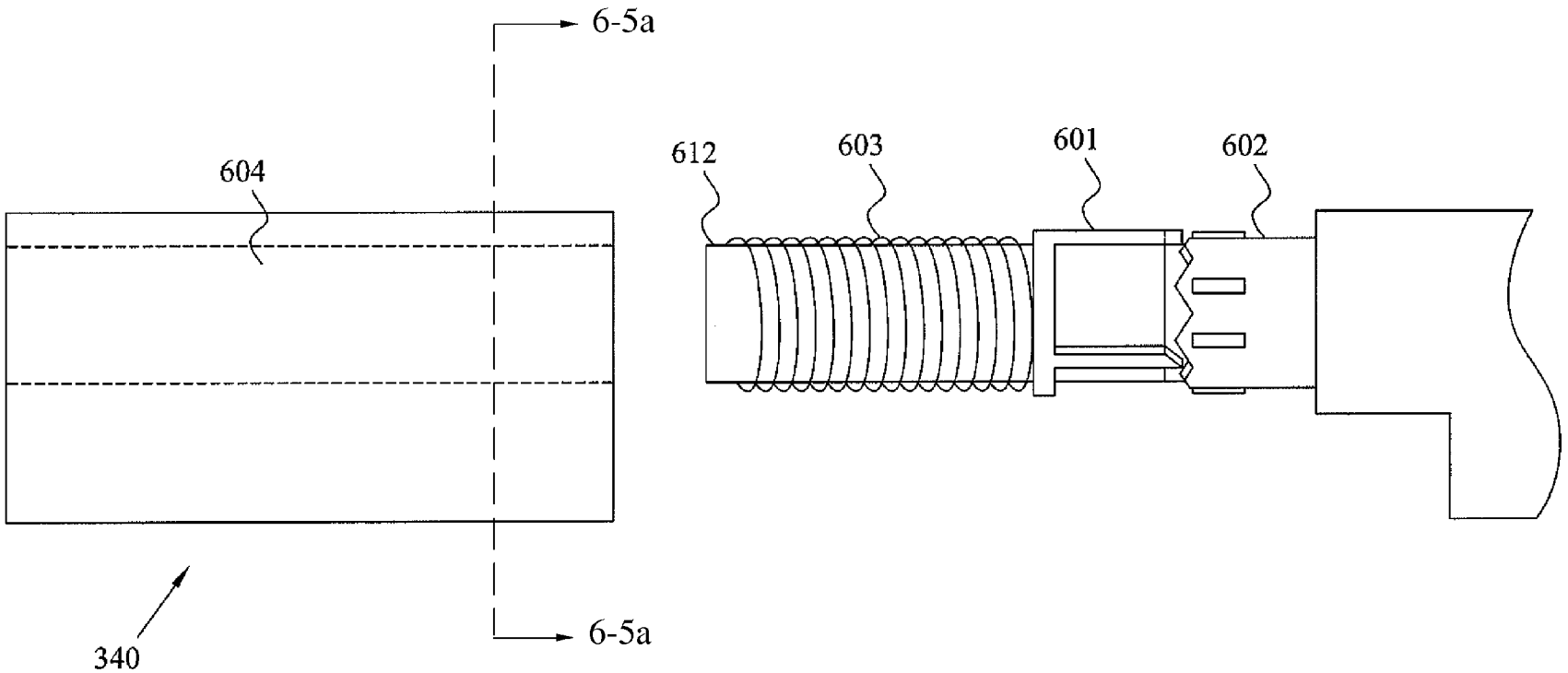
Figures 5A, 6:
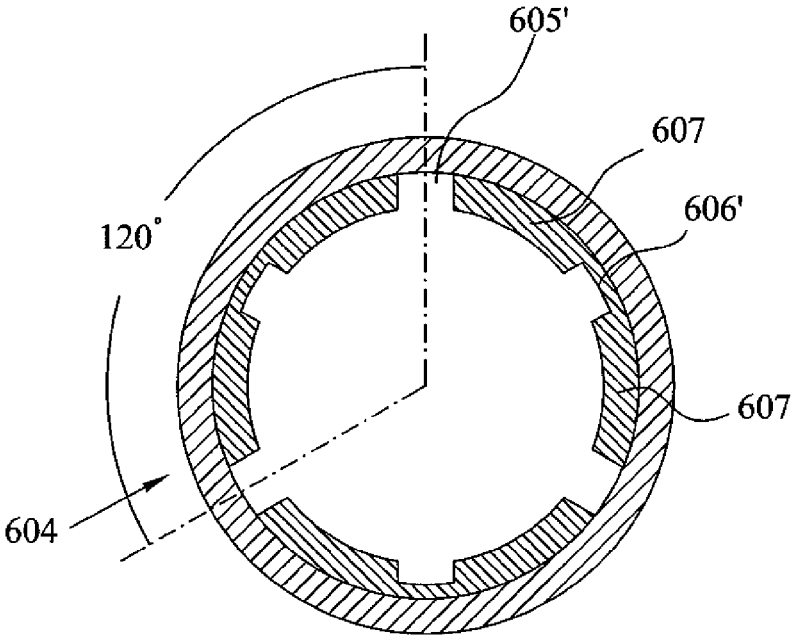

FIGS. 6-3*a* and 6-3*b* depict other side views of the second potion 302 of the adapter 300 according to an embodiment of the present invention connected with a spring. As shown, after the rod 612 is inserted into the rotor member 601, a spring 603 is then put around the rod 612 to be against the chassis 608 of the rotor member 601. FIG. 6-4 depicts another side view showing an embodiment of the present invention in which the second portion 302 of the adapter 300 is inserted into a hollow cylinder member 604 inside the first female end 340 of the first portion 301. FIG. 6-5A is a cross-sectional view of the hollow cylinder member 604 of FIG. 6-4 along line 6-5*a*6-5*a*. This cross-sectional view is thus depicted in FIG. 6-5*a*.

Figures 5B, 6:
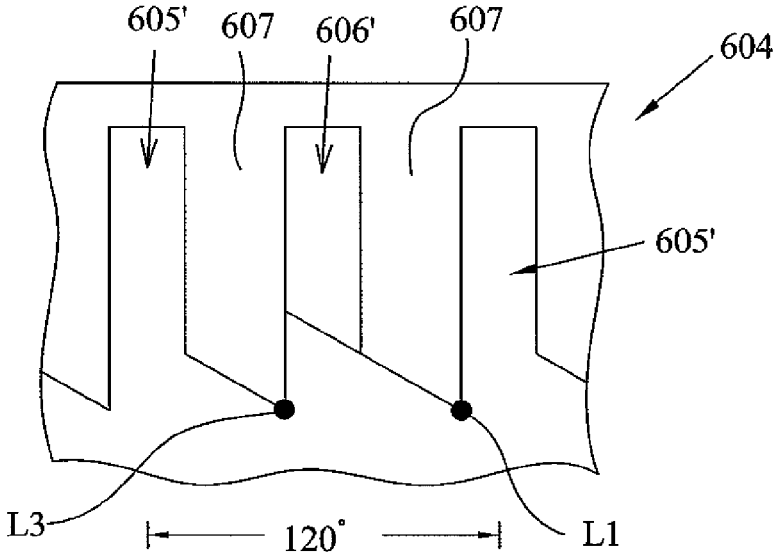

FIG. 6-5*b* is a plan view of a surface covering 120 degrees of an inner wall of the hollow cylinder member 604. The hollow cylinder member 604 comprises tracks 614, which allow the protruding ears 605 of the rotor member 601 to slide in, and tracks 616 which allow the protruding ears 606 of the actuator 602 to slide in. Because the radial thickness (a) of each of the protruding ears 605 of the rotor member 601 is larger than the radial thickness (b) of each of the protruding ears 606 of the actuator 602, the protruding ears 605 of the rotor member 601 cannot slide in the tracks 616.

When the second portion 302 is pushed forward to make the actuator 602 push the rotor member 601 at the first time (i.e., at time "Ti") and the L2 point (depicted in FIG. 6-2*c*) of the rotor member 601 exceeds the L1 point of the hollow cylinder member 604, the actuator 602 and the rotor member 601 will be completely engaged, as shown in FIG. 6-2*c*, and the rotor member 601 may be rotated along a small angle, and the slope surface of one of the protruding ears 605 of the rotor member 601 may further slide along the slope surface at the L1 point. As described, because the radial thickness (a) of each of the protruding ears 605 is larger than the radial thickness (b) of each of the protruding ears 606, the rotor member 601 cannot slide in the tracks 616, and thus stays at the entrances of the tracks 616. At this time, the spring 603 is not loosened (compressed), so that the adapter 300 is under a state of electrical connection, and thus is in an "ON" state.

When the second portion 302 is pushed forward to make the actuator 602 push the rotor member 601 at the second time (i.e., at time "T2", which is subsequent to time "Ti"), and the L2 point of the rotor member 601 exceeds the L3 point of the hollow cylinder member 604, the actuator 602 and the rotor member 601 are completely engaged, as shown in FIG. 6-2*c*, and the rotor member 601 may be rotated along a small angle, and the slope surface of one of the protruding ears 605 of the rotor member 601 may further slide along the slope surface at the L3 point. As depicted and described herein, the protruding ears 605 can slide in the tracks 614. At this time, the spring 603 is loosened and the second female end 310 is withdrawn, so that the adapter 300 is under a state of electrical disconnection, and thus is in an "OFF" state.

Although in the embodiment according to the present invention the RJ45 plug is taken as an example, the RJ11 plug, the MT-RJ plug and LC optical fiber plug can also be used in the embodiment. The term "RJxx" is used for indicating the plugs including the RJ45 plug and the RJ11 plug. Furthermore, the push latch in the present invention may have many other forms, such as described in the embodiments disclosed by U.S. Pat. Nos. 4,319,106, 5,043,546 or 6,585,388.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all described embodiments of the invention.

The foregoing detailed description of the embodiments is used to further clearly describe the features and spirit of the present invention. The foregoing description for each embodiment is not intended to limit the scope of the present invention. Hence, the scope of the present invention should be interpreted broadly according to the claims presented in connection with the detailed description, and cover all the possibly equivalent variations and equivalent arrangements.

What is claimed is:

1. An electrical adapter for identifying a connection state to a network, the electrical adapter comprising:

a first portion comprising:

a male end, disposed at a first end of the first portion and substantially similar to a connector plug and electrically connectable to a wall outlet or a corresponding female receptacle on another device when engaged therewith, and a first female end, disposed at a second end of the first portion and including a hollow cylinder member and a display window; and a second portion comprising a second female end, wherein the second female end comprises a push latch and a mark for identifying a connection state to a network on a surface of the second female end, wherein the push latch is contained in the hollow cylinder member, and wherein in response to the second portion being pushed against the first portion, the second female end is engaged with the first female end via the push latch, and the display window displays the mark identifying the connection state to the network.

2. The electrical adapter of claim 1, wherein the connector plug is from a group consisting of an RJ45 plug, an RJ11 plug, an MT-RJ plug, and an LC optical fiber plug.

3. The electrical adapter of claim 1, wherein the push latch comprises a rotor member, a spring, and an actuator member, wherein the rotor member is spring-loaded to engage against the actuator member to secure the second portion to the first portion when the first portion is inserted into the wall outlet or the corresponding female receptacle on said another device.

4. The electrical adapter of claim 3, wherein if the spring is compressed, the second female end is engaged with the first female end and the push latch is locked, resulting in the electrical adapter being electrically coupled to the network.

5. The electrical adapter of claim 3, wherein the actuator member comprises a toothed edge comprising multiple peaks of a first quantity, wherein the toothed edge comprises multiple equidistant protruding ears of the first quantity which respectively have a radial thickness b and extend outwardly from an exterior of the multiple peaks; wherein a first end of the rotor member has a toothed edge comprising peaks of a second quantity that is one-half of the first quantity, wherein the rotor member comprises equidistant protruding ears of the second quantity which respectively have a radial thickness a and extend outwardly from the exterior of the multiple peaks, wherein the radial thickness a is larger than the radial thickness b, and wherein a top of each of the protruding ears of the rotor member with the radial thickness a is a sloped surface.

6. The electrical adapter of claim 5, wherein the hollow cylinder member comprises first tracks which have a radial thickness a, wherein the first tracks allow the protruding ears of the rotor member to slide therein, wherein the hollow cylinder member further comprises second tracks that have a radial thickness b, wherein the second tracks allow the protruding ears of the actuator to slide therein, and wherein the radial thickness a is larger than the radial thickness b, wherein the protruding ears of the rotor member cannot slide into the second tracks.

7. The electrical adapter of claim 5, wherein in response to the second portion being moved to cause the actuator to push against the rotor member, and in response to a vertex of the sloped surface at a top of each of the protruding ears of the rotor member exceeding a predetermined point of the hollow cylinder member, the rotor member rotates and the sloped surface of one of the protruding ears of the rotor member further slides along a sloped surface at the predetermined point and stays at an entrance of one of the second tracks, and wherein the second portion being moved causes the spring to be compressed, wherein the electrical adapter is electrically connected to the network.

8. The electrical adapter of claim 1, wherein the mark for identifying the connection state of network employs colors to represent the connection state to the network.

* * * * *